US006203694B1

(12) United States Patent
Love et al.

(10) Patent No.: US 6,203,694 B1
(45) Date of Patent: Mar. 20, 2001

(54) CONVERSION OF HEAVY HYDROCARBON TO AROMATICS AND LIGHT OLEFINS

(75) Inventors: Scott Douglas Love; Charles Alfred Drake, both of Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/078,030

(22) Filed: May 13, 1998

(51) Int. Cl.[7] ..... C10G 35/06

(52) U.S. Cl. ..... 208/135; 208/120.01; 208/141; 585/653; 585/655; 585/656

(58) Field of Search ..... 208/120.01, 135, 208/141; 585/653, 655, 656

(56) References Cited

U.S. PATENT DOCUMENTS

| | | | | |
|---|---|---|---|---|
| 3,167,495 | * | 1/1965 | Ramella | 208/139 |
| 3,617,486 | * | 11/1971 | Lewis et al. | 208/59 |
| 3,756,942 | | 9/1973 | Cattanach | 208/137 |
| 4,097,367 | | 6/1978 | Haag et al. | 208/135 |
| 4,356,338 | | 10/1982 | Young | 585/407 |
| 4,390,413 | * | 6/1983 | O'Rear et al. | 208/61 |
| 4,751,338 | | 6/1988 | Tabak et al. | 585/415 |
| 4,863,585 | * | 9/1989 | Herbst et al. | 208/113 |
| 4,922,051 | * | 5/1990 | Nemet-Mavrodin et al. | 585/418 |
| 4,966,681 | * | 10/1990 | Herbst et al. | 208/74 |
| 5,059,735 | | 10/1991 | Nemet-Mavrodin | 585/418 |
| 5,186,908 | | 2/1993 | Nemet-Mavrodin et al. | 422/190 |
| 5,252,197 | * | 10/1993 | Alexander et al. | 208/134 |
| 5,409,595 | * | 4/1995 | Harandi et al. | 208/60 |
| 5,549,813 | * | 8/1996 | Dai et al. | 208/120 |
| 5,585,530 | * | 12/1996 | Gough et al. | 585/257 |
| 5,639,926 | * | 6/1997 | Turner et al. | 585/259 |
| 5,670,037 | * | 9/1997 | Zaiting et al. | 208/114 |
| 5,780,703 | * | 7/1998 | Chang et al. | 585/732 |
| 5,837,127 | * | 11/1998 | Gough et al. | 208/60 |
| 5,866,744 | * | 2/1999 | Wu et al. | 585/486 |

OTHER PUBLICATIONS

U.S. application No. 09/114,992, filed Jul. 14, 1998.
U.S. application No. 09/022,628, filed Feb. 12, 1998.
U.S. application No. 09/035,198, filed Mar. 5, 1998.

* cited by examiner

*Primary Examiner*—Walter D. Griffin
*Assistant Examiner*—Nadine Preisch
(74) *Attorney, Agent, or Firm*—Jeffrey R. Anderson

(57) ABSTRACT

A method for optimizing the yield of light olefins in a process for the conversion of a heavy hydrocarbon stream to aromatics and light olefins by contacting the heavy hydrocarbon stream with a zeolite catalyst along with the controlled introduction of a paraffin stream co-feed.

33 Claims, 1 Drawing Sheet

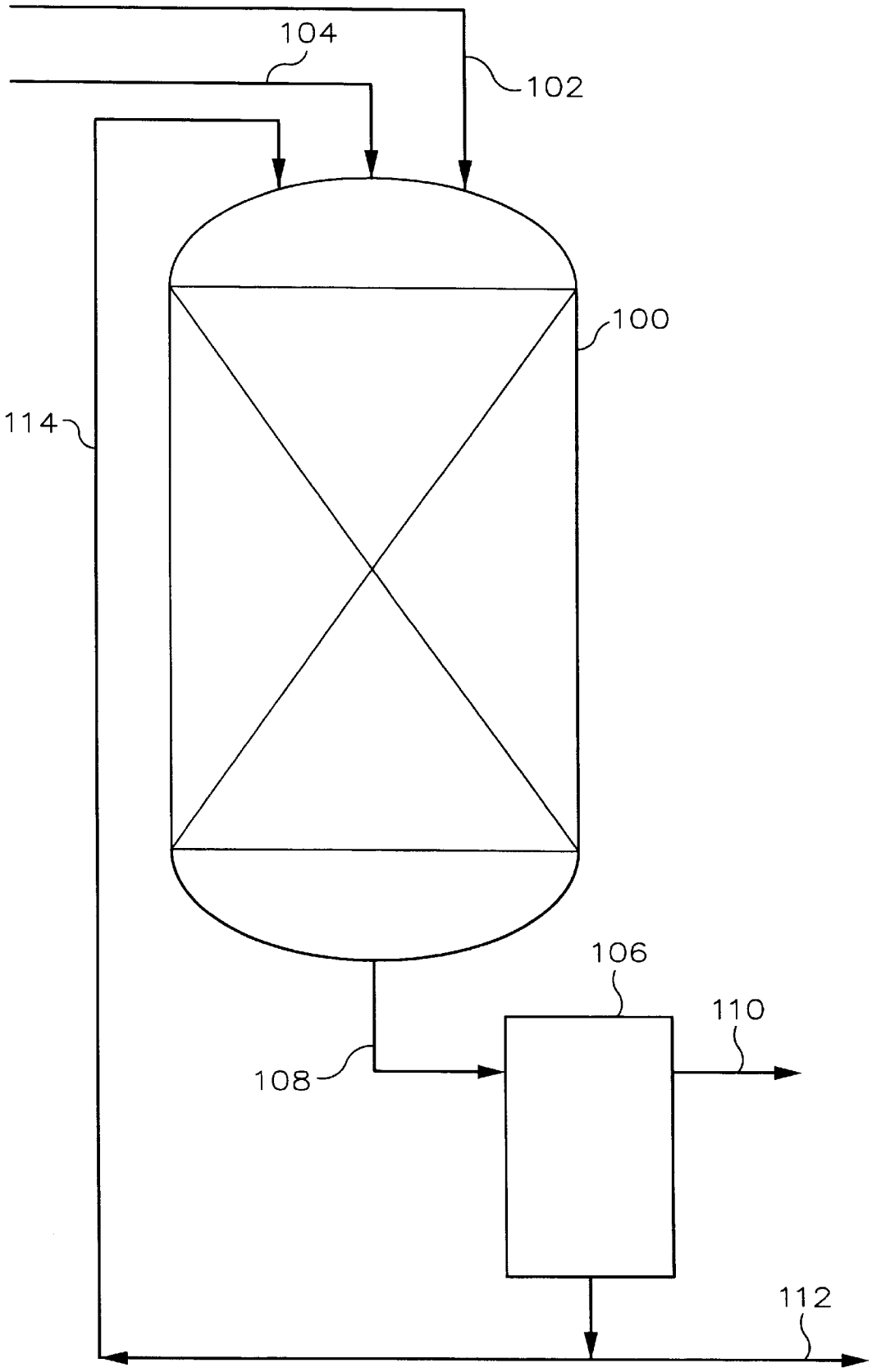
104
102
100
114
106
110
108
112

CONVERSION OF HEAVY HYDROCARBON TO AROMATICS AND LIGHT OLEFINS

BACKGROUND OF THE INVENTION

The present invention relates to the field of hydrocarbon upgrading processes. In another aspect, the invention relates to the conversion of heavy hydrocarbon streams to aromatics and ethylene, propylene and butylene.

Developments in zeolite catalysts useful in hydrocarbon conversion processes have led to the use of zeolite catalysts for the conversion of heavy hydrocarbon streams containing heavy olefins to aromatics without the addition of hydrogen. The conversion of $C_2$–$C_4$ alkanes and alkenes to produce aromatics using zeolite catalysts was found to be an effective process by both Cattanach (U.S. Pat. Nos. 3,760,024 and 3,756,942) and Yan et al. (U.S. Pat. No. 3,845,150). Nemet-Marrodin et al. have added to the understanding of the conversion of heavy hydrocarbon streams containing heavy olefins to aromatics using zeolite catalysts by suggesting the use of a purified recycle stream in U.S. Pat. No. 5,186,908. Other patents representative of aromatization of heavy hydrocarbon streams containing heavy olefins using zeolite catalysts include Young, U.S. Pat. No. 4,356,338, which discloses reducing coke formation on zeolite catalysts by treating the catalyst with phosphorus and steam, and Tabak et al., U.S. Pat. No. 4,751,338, which discloses continuous catalyst regeneration and the recycle of $C_5$+ aliphatics in a fluidized bed.

These processes are effective in preferentially converting heavy hydrocarbons to aromatics at the expense of light olefin yield. Also, there is limited flexibility in these processes to shift the conversion of heavy hydrocarbons from aromatics to light olefins. Therefore, development of a process for converting heavy hydrocarbons to aromatics and light olefins wherein the yield of light olefins is enhanced would be a significant contribution to the art and to the economy by allowing the flexibility to preferentially convert heavy hydrocarbons to either aromatics or light olefins depending on market conditions.

BRIEF SUMMARY OF THE INVENTION

It is, thus, an object of this invention to provide a process for converting heavy hydrocarbon streams to aromatics and ethylene, propylene and butylene.

A further object of this invention is to provide a method for increasing the conversion of heavy hydrocarbons to light olefins in a process for the conversion of heavy hydrocarbon streams to aromatics and light olefins.

In accordance with the present invention, a method has been found for increasing the conversion of heavy hydrocarbons to light olefins in a process for the conversion of heavy hydrocarbon streams to aromatics (BTX) and light olefins. The method includes the steps of:

(a) introducing a heavy hydrocarbon having at least 5 carbon atoms per molecule into a reaction zone containing a zeolite catalyst and operating the reaction zone under reaction conditions sufficient for converting the heavy hydrocarbon to light olefins and BTX;

(b) introducing a paraffin stream comprising pentane into the reaction zone as a co-feed with the heavy hydrocarbon;

(c) withdrawing from the reaction zone a reactor effluent comprising light olefins;

(d) identifying a percent conversion of the heavy hydrocarbon to light olefins when there is no introducing step (b); and (e) controlling the rate of introduction of the paraffin of introducing step (b) such that the percent conversion of the heavy hydrocarbon to light olefins exceeds the percent conversion of identifying step (d).

Other objects and advantages will become apparent from the detailed description and the appended claims.

BRIEF DESCRIPTION OF THE DRAWINGS

The FIGURE presents a schematic flow diagram representing an embodiment of the present invention.

DETAILED DESCRIPTION OF THE INVENTION

The process of this invention involves the catalytic conversion of heavy hydrocarbons to produce desirable hydrocarbon end-products. A heavy hydrocarbon stream is fed or charged to a reaction zone containing a zeolite catalyst.

The heavy hydrocarbon stream can comprise paraffins and/or olefins and/or naphthenes and/or aromatics, wherein each of these hydrocarbons contains at least 5 carbon atoms per molecule. Non-limiting examples of suitable heavy hydrocarbon stream feedstocks include gasolines from catalytic oil cracking (e.g., FCC and hydrocracking) processes, pyrolysis gasolines from thermal hydrocarbon (e.g., ethane, propane, and naphtha) cracking processes, coker naphtha, light coker naphtha and the like. The preferred heavy hydrocarbon stream feedstock is a gasoline-boiling range hydrocarbon feedstock suitable for use as at least a gasoline blend stock generally having a boiling range of about 30–210° C. The most preferred heavy hydrocarbon stream feedstock is a cracked gasoline, for example, gasolines from catalytic oil cracking processes, pyrolysis gasoline, and coker naphtha, necessarily containing saturates and non-saturates.

It has been discovered that the introduction of a paraffin stream as a co-feed, comprising a paraffin selected from the group consisting of pentane, hexane, heptane and octane, to the reaction zone along with the heavy hydrocarbon stream results in an increased yield of light olefins (ethylene, propylene or butylene) over the light olefin yield in a process where the paraffin stream co-feed is not introduced to the reaction zone. The preferred paraffin stream co-feed is pentane.

A percent conversion is identified representing the percent conversion of the heavy hydrocarbon stream to light olefins when there is no introduction of the paraffin stream co-feed. The identified percent conversion of the heavy hydrocarbon stream to light olefins is more particularly in the range of from about 20 to about 35 weight %; preferably in the range of from about 20 to about 30; and most preferably from 25 to 30. The paraffin stream co-feed is then controllably introduced to the reaction zone resulting in a mole ratio of the paraffin stream co-feed to the heavy hydrocarbon stream.

According to the present invention, the mole ratio of the paraffin stream co-feed to the heavy hydrocarbon stream can be any ratio that can enhance the percent conversion of the heavy hydrocarbon stream to light olefins over the identified percent conversion when there is no introduction of the paraffin stream co-feed. The percent conversion of the heavy hydrocarbon stream to light olefins when there is a controlled introduction of the paraffin stream co-feed is more particularly in the range of from about 40 to about 60 weight %; preferably in the range of from about 40 to about 55; and most preferably from 40 to 50. The mole ratio of the paraffin stream co-feed to the heavy hydrocarbon stream can be in the range of from about 0.01:1 to about 100:1; preferably from about 0.0125:1 to about 80:1; and most preferably from 0.0625:1 to 16:1.

The paraffin stream co-feed can be controllably introduced to the reaction zone in any manner suitable for providing the mole ratio described above resulting in increased percent conversion of heavy hydrocarbons to benzene, toluene, xylene (BTX) and light olefins (petrochemicals), and especially conversion to light olefins. Use of the lighter paraffins, pentane and hexane, in the paraffin stream co-feed as compared to the use of the heavier paraffins, heptane and octane, is expected to result in higher light olefins yield but at a lower total conversion.

The reactor effluent resulting from the practice of this process will have a significant increase in light olefins as compared to the reactor effluent where the paraffin stream co-feed is not introduced to the reaction zone. The reactor effluent can further include aromatics. Thus, the reactor effluent may comprise a light olefin, such as, ethylene, propylene, or butylenes, and an aromatic, such as, benzene, toluene or xylene. It is preferred for the reactor effluent to contain both light olefins and aromatics and, most preferably, the reactor effluent includes ethylene, propylene, butylene and BTX.

The weight percent of petrochemicals in the reactor effluent is more particularly in the range of from about 55 to about 75; preferably in the range of from about 55 to about 70; and most preferably from 55 to 65.

The reactor effluent is separated into a product stream and a recyclable stream. The product stream can comprise a light olefin, such as, ethylene, propylene, butylenes or an aromatic such as, benzene, toluene and xylene, or a $C_9^+$ aromatic, or a paraffin having 4 or fewer carbon atoms per molecule, or any combination thereof. Preferably, the product stream comprises at least one light olefin and at least one aromatic. The product stream can be further processed into various petrochemical products. The recyclable stream can comprise a paraffin hydrocarbon selected from the group consisting of hydrocarbons having 5 or more carbon atoms per molecule. Preferably, the paraffin hydrocarbon of the recyclable stream is pentane or hexane, or both.

A further embodiment of the invention includes recycling at least a portion of the recyclable stream as a feed to the reaction zone. The remaining portion of the recyclable stream may be further used in other refining processes to produce petrochemical products. Recycling at least a portion of the recyclable stream to the reaction zone enhances the yield of light olefins. Again, the increase in light olefin yield is likely due to the increase in paraffin concentration of the feed mixture. According to the present invention, the amount of recycle from the recyclable stream can be any amount that can enhance the yield of light olefins. The weight percent of the recyclable stream recycled to the reaction zone can be in the range of from about 1 to about 100, preferably from about 10 to about 100, and most preferably 20 to 100. The remaining portion of the recyclable stream not recycled to the reaction zone may be passed downstream for further processing.

The reaction zone is operated at a temperature in the range of from about 400° C. to about 800° C., preferably from about 450° C. to about 750° C., and most preferably from 500° C. to 700° C.; a pressure in the range of from about 0 psia (pounds per square inch absolute) to about 500 psia, preferably from about 0 psia to about 450 psia, and most preferably from 20 psia to 400 psia; and a weight hourly space velocity (WHSV, defined as the pounds/hour of feed to the reaction zone divided by the total pounds of zeolite catalyst contained within the reaction zone) in the range of from about 0.01 $hr.^{-1}$ to about 1000 $hr.^{-1}$, preferably from about 0.25 $hr.^{-1}$ to about 250 $hr.^{-1}$, and most preferably from 0.5 $hr.^{-1}$ to 100 $hr.^{-1}$.

The reaction can take place in any reactor system known to those skilled in the art to be suitable for use in converting a heavy hydrocarbon to light olefins and aromatics in the presence of a zeolite catalyst. Typical reactor systems useful in the present invention include, but are not limited to, a fixed bed system, a moving bed system, a fluidized bed system and batch type operations.

The catalyst composition useful in the present invention can comprise, consist essentially of, or consist of a catalytic component and an activity promoter. The catalytic component is a zeolite, an acid-leached zeolite, or combinations thereof. The promoter is preferably impregnated or coated on the catalytic component.

The weight of the promoter in the composition can be in the range of from about 0.01 to about 10, preferably about 0.05 to about 8, and most preferably 0.1 to 5 grams per 100 grams of the composition.

The composition can also comprise a binder. The weight of the binder generally can be in the range of from about 1 to about 50, preferably about 5 to about 40, and most preferably 5 to 35 grams per 100 grams of the composition. The catalytic component generally makes up the rest of the composition.

Any commercially available zeolite which can catalyze the conversion of a hydrocarbon to an aromatic compound and an olefin can be employed. Examples of suitable zeolites include, but are not limited to, those disclosed in Kirk-Othmer Encyclopedia of Chemical Technology, third edition, volume 15 (John Wiley & Sons, New York, 1991) and in W. M. Meier and D. H. Olson, "Atlas of Zeolite Structure Types," pages 138–139 (Butterworth-Heineman, Boston, Mass., 3rd ed. 1992). The presently preferred zeolites are those having medium pore sizes. ZSM-5 and similar zeolites that have been identified as having a framework topology identified as MFI are particularly preferred because of their shape selectivity.

Any promoter that can enhance the production of olefins in an aromatization process which converts a hydrocarbon or a mixture of hydrocarbons into light olefins and aromatic hydrocarbons can be used. The term "promoter" generally refers to either metal or a metal oxide selected from Groups IA, IIA, IIIA, IVA, VA, VIA, IIB, IIIB, IVB, VB, VIB, and VIII of the CAS version of the Periodic Table of Elements, CRC Handbook of Chemistry and Physics, Boca Raton, Fla. (74th edition; 1993–1994). The term "metal" used herein refers to both "metal" and "elements" of the Periodic Table because some elements may not be considered as metals by those skilled in the art. The term "metal" also includes metal oxide. Examples of such promoters include, but are not limited to, sulfur, phosphorus, silicon, boron, tin, magnesium, germanium, zinc, titanium, zirconium, molybdenum, lanthanum, cesium, iron, cobalt, nickel, and combinations of two or more thereof.

Any binders known to one skilled in the art for use with a zeolite are suitable for use herein. Examples of suitable binders include, but are not limited to, clays such as for example, kaolinite, halloysite, vermiculite, chlorite, attapulgite, smectite, montmorillonite, illite, saconite, sepiolite, palygorskite, diatomaceous earth, and combinations of any two or more thereof; aluminas such as for example α-alumina and γ-alumina; silicas; alumina-silica; aluminum phosphate; aluminum chlorohydrate; and combinations of two or more thereof. Because these binders are well known to one skilled in the art, description of which is omitted herein. The presently preferred binders are alumina and silica because they are readily available.

The catalyst composition can be prepared by combining a catalytic component, a promoter, and a binder in the weight percent disclosed above under any conditions sufficient to effect the production of such a composition.

The catalyst composition useful in the present invention can be produced by first optionally combining a catalytic component with a binder disclosed above under a condition sufficient to produce a catalytic component-binder mixture.

A zeolite, preferably a ZSM-5 zeolite or acid-leached ZSM-5 zeolite and the binder can be well mixed by any means known to one skilled in the art such as stirring, blending, kneading, or extrusion, following which the catalytic component-binder mixture can be dried in air at a temperature in the range of from about 20 to about 800° C., for about 0.5 to about 50 hours under any pressures that accommodate the temperatures, preferably under atmospheric pressure. Thereafter, the dried, catalytic component-binder mixture can be further calcined, if desired, in air at a temperature in the range of from about 300 to 1000° C., preferably about 350 to about 750° C., and most preferably 450 to 650° C. for about 1 to about 30 hours to prepare a calcined catalytic component-binder. Before a binder is combined with a zeolite, the zeolite can also be calcined under similar conditions to remove any contaminants, if present, to prepare a calcined zeolite.

A zeolite, whether it has been calcined or contains a binder, can also be treated with an acid. Generally, any organic acids, inorganic acids, or combinations of any two or more thereof can be used in the preparation of this catalyst composition so long as the acid can reduce the aluminum content in the zeolite. The acid can also be a diluted aqueous acid solution. Examples of suitable acids include, but are not limited to, sulfuric acid, hydrochloric acid, nitric acid, phosphoric acid, formic acid, acetic acid, trifluoroacetic acid, trichloroacetic acid, p-toluenesulfonic acid, methanesulfonic acid, partially or fully neutralized acids wherein one or more protons have been replaced with, for example, a metal (preferably an alkali metal) or ammonium ion, and combinations of any two or more thereof. Examples of partially neutralized acids include, but are not limited to, sodium bisulfate, sodium dihydrogen phosphate, potassium hydrogen tartarate, ammonium sulfate, ammonium chloride, ammonium nitrate, and combinations thereof. The presently preferred acids are hydrochloric acid and nitric acid for they are readily available.

Any methods known to one skilled in the art for treating a solid catalyst with an acid can be used in the acid treatment of the catalyst composition. Generally, a catalytic component can be suspended in an acid solution. The concentration of the catalytic component in the acid solution can be in the range of from about 0.01 to about 500, preferably about 0.1 to about 400, more preferably about 1 to about 350, and most preferably 5 to 300 grams per liter. The amount of acid required is the amount that can maintain the solution in acidic pH during the treatment. Preferably the initial pH of the acid solution containing a zeolite is adjusted to lower than about 6, preferably lower than about 5, more preferably lower than about 4, and most preferably lower than 3. Upon the pH adjustment of the solution, the solution can be subjected to a treatment at a temperature in the range of from about 30° C. to about 200° C., preferably about 50° C. to about 150° C., and most preferably 70° C. to 120° C. for about 10 minutes to about 30 hours, preferably about 20 minutes to about 25 hours, and most preferably 30 minutes to 20 hours. The treatment can be carried out under a pressure in the range of from about 1 to about 10 atmospheres (atm) absolute, preferably about 1 atm so long as the desired temperature can be maintained. Thereafter, the acid-treated catalytic component can be washed with running water for 1 to about 60 minutes followed by drying, at about 50 to about 1000, preferably about 75 to about 750, and most preferably 100 to 650° C. for about 0.5 to about 15, preferably about 1 to about 12, and most preferably 1 to 10 hours, to produce an acid-leached catalytic component. Any drying method known to one skilled in the art such as, for example, air drying, heat drying, spray drying, fluidized bed drying, or combinations of two or more thereof can be used.

The dried, acid-leached catalytic component can also be further washed, if desired, with a mild acid solution such as, for example, ammonium nitrate which is capable of maintaining the pH of the wash solution in acidic range. The volume of the acid generally can be the same volume as that disclosed above. The mild acid treatment can also be carried out under substantially the same conditions disclosed in the acid treatment disclosed above. Thereafter, the resulting solid can be washed and dried as disclosed above.

The dried, acid-leached catalytic component, whether it has been further washed with a mild acid or not, can be calcined, if desired, under a condition known to those skilled in the art. Generally such a condition can include a temperature in the range of from about 250 to about 1,000, preferably about 350 to about 750, and most preferably 450 to 650° C. and a pressure in the range of from about 0.5 to about 50, preferably about 0.5 to about 30, and most preferably 0.5 to 10 atmospheres (atm) for about 1 to about 30 hours, preferably about 2 to about 20 hours, and most preferably 3 to 15 hours.

The ions in a zeolite can be changed by ion-exchange. The ion exchange of exchangeable ions in a zeolite is well known to one skilled in the art. See, for example, U.S. Pat. No. 5,516,956, disclosure of which is incorporated herein by reference. Because the ion exchange procedure is well known, the description of which is omitted herein for the interest of brevity.

The catalytic component or a catalytic component-binder mixture, which could have been acid-leached, in a desired ionic form, regardless whether calcined or not, is contacted with a promoter precursor compound, preferably in a solution or suspension, under a condition known to those skilled in the art to incorporate a promoter precursor compound into a catalytic component. Preferably the promoter precursor compound is impregnated onto the catalytic component or catalytic component-binder mixture. Because the methods for incorporating or impregnating a promoter precursor compound into a catalytic component or catalytic component-binder mixture such as, for example, impregnation by incipient wetness method, are well known to those skilled in the art, the description of which is also omitted herein for the interest of brevity.

Any promoter precursor compound, which upon being incorporated into, or impregnated or coated onto, a catalytic component or catalytic component-binder mixture can be converted into a promoter, as disclosed above, upon calcining can be used. The preferred promoter precursor compounds are those selected from Group IA, IIA, IIIA, IVA, VA, VIA, IIB, IIIB, IVB, VB, VIB, and VIII. Presently it is most preferred that a promoter precursor be selected from the group consisting of sulfur compounds, phosphorus compounds, silicon compounds, boron compounds, magnesium compounds, zinc compounds, tin compounds, titanium compounds, zirconium compounds, molybdenum compounds, germanium compounds, indium compounds, lanthanum compounds, cesium compounds, iron compounds, nickel compounds, chromium compounds, cobalt compounds, and combinations of two or more thereof. The most preferred promoter compound is phosphorus.

Generally any silicon compounds which can be converted to a silicon oxide that are effective for converting a heavy hydrocarbon to light olefins and BTX using a zeolite can be used. Examples of suitable silicon compounds can have a formula of $(R)(R)(R)Si—(O_mSi(R)(R))_nR$ wherein each R can be the same or different and is independently selected from the group consisting of alkyl radicals, alkenyl radicals, aryl radicals, alkaryl radicals, aralkyl radicals, and combinations of any two or more thereof; m is 0 or 1; and n is 1 to about 10 wherein each radical can contain 1 to about 15, preferably 1 to about 10 carbon atoms per radical. Specific examples of such polymers include, but are not limited to, silicon-containing polymers such as poly(phenylmethyl) siloxane, poly(phenylethylsiloxane), poly (phenylpropylsiloxane), hexamethyldisiloxane, decamethyltetrasiloxane, diphenyltetramethyldisiloxane, and combinations of two or more thereof. Other silicon-containing compounds include organosilicates such as, for example, tetraethyl orthosilicate, tetrabutyl orthosilicate, tetrapropyl orthosilicate, or combination of two or more thereof. A number of well known silylating agents such as trimethylchlorosilane, chloromethyldimethylchlorosilane, N-trimethylsilylimidazole, N,O-bis(trimethylsilyl) acetamide, N-methyl-N-trimethylsilyltrifluoroacetamie, t-butyldimethylsilylimidazole, N-trimethylsilylacetamide, methyltrimethoxysilane, vinyltriethoxysilane, ethyltrimethoxysilane, propyltrimethoxysilane, (3,3,3-trifluoropropyl)trimethoxysilane, [3-(2-aminoethyl) aminopropyl]trimethoxysilane, cyanoethyltrimethoxysilane, aminopropyltriethoxysilane, phenyltrimethoxysilane, (3-chloropropyl)trimethoxysilane, (3-mercaptopropyl) trimethoxysilane, (3-glycidoxypropyl)trimethoxysilane, vinyltris(β-methoxyethoxy)silane, (γ-methacryloxypropyl) trimethoxysilane, vinylbenzyl cationic silane, (4-aminopropyl)triethoxysilane, [γ-(β-aminoethylamino) propyl]trimethoxysilane, (γ-glycidoxypropyl) trimethoxysilane, [β-(3,4-epoxycyclohexyl)ethyl] trimethoxysilane, (β-mercaptoethyl)trimethoxysilane, (γ-chloropropyl)trimethoxysilane, and combinations of two or more thereof can also be employed. The presently preferred silicon-containing compounds are tetraethyl orthosilicate, which is also known as tetraethoxysilane, and poly(phenylmethyl) siloxane.

Similarly, any phosphorus compounds that, when impregnated onto or incorporated into a zeolite can be converted into a phosphorus oxide can be used. Examples of suitable phosphorus compounds include, but are not limited to, phosphorus pentoxide, phosphorus oxychloride, phosphoric acid, organic phosphates, $P(OR)_3$ $P(O)(OR)_3$, P(O)(R)(R)(R), P(R)(R)(R), and combinations of two or more thereof wherein R is the same as that disclosed above. Examples of suitable organic phosphates include, but are not limited to, trimethylphosphate, triethylphosphate, tripropylphosphate, and combination of two or more thereof. The presently preferred organic phosphates are trimethylphosphate and triethylphosphate for they are readily available.

Any sulfur compound that can be converted to a sulfur oxide upon calcining can be employed. Examples of suitable sulfur compounds include, but are not limited to, $(RSH)_n$, $RS_nR$, RS(O)R, RS(O)(O)R, $M_zS$, $SX_z$, $SO_zX_z$, $CO_mS_z$, $M_zH_mSO_4$, or combinations of two or more thereof wherein each R, m, and n are the same as those disclosed above, z is a number that fills the proper valency of M or X in which M is an alkali metal ion, an alkaline earth metal ion, an ammonium ion, or H, and X is a halogen or hydrogen. Specific examples of sulfur compounds include, but are not limited to, ammonium sulfide, sodium sulfide, ammonium hydrogen sulfate, sodium hydrogen sulfide, potassium hydrogen sulfide, dimethyl disulfide, methyl mercaptan, diethyl disulfide, dibutyl trisulfide, sulfuryl chloride, sulfur monochloride, dinonyl tetrasulfide, hydrogen sulfide, carbon disulfide, carbonyl sulfide, sulfonyl chloride, or combinations of two or more thereof.

Similarly, examples of suitable tin compounds include, but are not limited to, stannous acetate, stannic acetate, stannous bromide, stannic bromide, stannous chloride, stannic chloride, stannous oxalate, stannous sulfate, stannic sulfate, stannous sulfide, and combinations of two or more thereof.

Examples of suitable zinc compounds include, but are not limited to, zinc titanate, zinc silicate, zinc borate, zinc fluorosilicate, zinc fluorotitanate, zinc molybdate, zinc chromate, zinc tungstate, zinc zirconate, zinc chromite, zinc aluminate, zinc phosphate, zinc acetate dihydrate, diethylzinc, zinc 2-ethylhexanoate, and combinations of two or more thereof.

Examples of suitable titanium compounds include, but are not limited to, titanium zinc titanate, lanthanum titanate, titanium tetramides, titanium tetramercaptides, titanium chloride, titanium oxalate, zinc titanate, tetraisopropyl titanate, tetra-n-butyl titanate, tetrakis(2-ethylhexyl) titanate, titanium tetramethoxide, titanium dimethoxydiethoxide, titanium tetraethoxide, titanium tetra-n-butoxide, titanium tetrahexyloxide, titanium tetradecyloxide, titanium tetraeicosyloxide, titanium tetracyclohexyloxide, titanium tetrabenzyloxide, titanium tetra-p-tolyloxide, titanium tetraphenoxide, and combinations of two or more thereof.

Similarly, examples of suitable magnesium compounds include, but are not limited to, magnesium silicate, magnesium nitrate, magnesium acetate, magnesium acetylacetoante, magnesium chloride, magnesium molybdate, magnesium hydroxide, magnesium sulfate, magnesium sulfide, magnesium titanate, magnesium tungstate, magnesium formate, magnesium bromide, magnesium bromide diethyl etherate, magnesium fluoride, dibutyl magnesium, magnesium methoxide, $Mg(OC_2H_5)_2$, $Mg(OSO_2CF_3)_2$, dipropyl magnesium, and combinations of two or more thereof.

Similarly, examples of suitable zirconium compounds include, but are not limited to, zirconium acetate, zirconium formate, zirconium chloride, zirconium bromide, zirconium butoxide, zirconium tert-butoxide, zirconium chloride, zirconium citrate, zirconium ethoxide, zirconium methoxide, zirconium propoxide, and combinations of two or more thereof.

Suitable molybdenum compounds include, but are not limited to, molybdenum(III) chloride, molybdenum(II) acetate, molybdenum(IV) chloride, molybdenum(V) chloride, molybdenum(VI) fluoride, molybdenum(VI) oxychloride, molybdenum(IV) sulfide, sodium molybdate, potassium molybdate, ammonium heptamolybdate(VI), ammonium phosphomolybdate(VI), ammonium dimolybdate(VI), ammonium tetrathiomolybdate(VI), or combinations of two or more thereof.

Examples of suitable germanium compounds include, but are not limited to, germanium chloride, germanium bromide, germanium ethoxide, germanium fluoride, germanium iodide, germanium methoxide, and combinations of any two or more thereof. Examples of suitable indium compounds include, but are not limited to indium acetate, indium bromide, indium chloride, indium fluoride, indium iodide, indium nitrate, indium phosphide, indium selenide, indium sulfate, and combinations of any two or more thereof. Examples of suitable lanthanum compounds include, but are not limited to, lanthanum acetate, lanthanum carbonate, lanthanum octanoate, lanthanum fluoride, lanthanum chloride, lanthanum bromide, lanthanum iodide, lanthanum nitrate, lanthanum perchlorate, lanthanum sulfate, lanthanum titanate, and combinations of two or more thereof.

A boron compound having a formula of $BR_{3-z}W_z$, $(R'BO)_3$, $BW_z$, $B(OR)_3$, or combinations of two or more thereof can be used in which R can be hydrogen, an alkyl radical, an alkenyl radical, an aryl radical, an aryl alkyl radical, alkyl arayl radical, and combinations of two or more thereof in which each radical can have 1 to about 20 carbon atoms, R' can be R, RO, RS, $R_2N$, $R_2P$, $R_3Si$, or combinations of two or more thereof, W can be a halogen, $NO_3$, $NO_2$, $SO_4$, $PO_4$, or combinations of two or more thereof, and z is an integer of 1 to 3. Examples of suitable boron compounds include, but are not limited to boric acid, borane-ammonium complex, boron trichloride, boron phosphate, boron nitride, triethyl borane, trimethyl borane, tripropyl borane, trimethyl borate, triethyl borate, tripropyl borate, trimethyl boroxine, triethyl boroxine, tripropyl boroxine, and combinations of two or more thereof.

Other suitable promoter compounds include, but are not limited to, sodium acetate, sodium acetylacetonate, sodium bromide, sodium iodide, sodium nitrate, sodium sulfate, sodium sulfide, potassium acetate, potassium acetylacetonate, potassium bromide, potassium chloride, potassium nitrate, potassium octanoate, potassium phosphate, potassium sulfate, tungsten bromide, tungsten chloride, tungsten hexacarbonyl, tungsten oxychloride, tungsten sulfide, tungstic acid, and combinations of any two or more thereof.

Upon the incorporation or impregnation of the promoter precursor compound onto the catalytic component or catalytic component-binder mixture to produce a promoter precursor-incorporated or -impregnated catalytic component, the promoter precursor-incorporated or -impregnated catalytic component can be subject to calcination under a condition that can include a temperature in the range of from about 300° C. to about 1000° C., preferably about 350° C. to about 750° C., and most preferably 400° C. to 650° C. under a pressure that accommodates the temperature, generally in the range of from about 1 to about 10 atmospheres (atm), preferably about 1 atm for a period in the range of from about 1 to about 30, preferably about 1 to about 20, and most preferably 1 to 15 hours to produce the catalyst composition.

The catalyst composition then can be, if desired, pretreated with a reducing agent before being used in a process for converting a heavy hydrocarbon to light olefins and aromatics. The presently preferred reducing agent is a hydrogen-containing fluid which comprises molecular hydrogen ($H_2$) in the range of from 1 to about 100, preferably about 5 to about 100, and most preferably 10 to 100 volume %. The reduction can be carried out at a temperature, in the range of from about 250° C. to about 800° C. for about 0.1 to about 10 hours, preferably about 300° C. to about 700° C. for about 0.5 to about 7 hours, and most preferably 350° C. to 650° C. for 1 to 5 hours.

Referring to the FIGURE, the heavy hydrocarbon stream and the paraffin co-feed enter reactor 100, which defines a reaction zone, via conduits 102 and 104, respectively, and contact a zeolite catalyst contained within the reaction zone. The hydrocarbon feed streams are converted to a reactor effluent which then flows to a product separation unit 106 via conduit 108 wherein the reactor effluent is separated into the product stream and the recyclable stream. The product stream exits product separation unit 106 via conduit 110 for further downstream separation into various products. The recyclable stream is removed from separation unit 106 via conduit 112 and at least a portion of the recyclable stream is recycled to reactor 100 via conduit 114. Any remaining portion of the recyclable stream flows downstream for further processing into various petrochemicals via conduit 112.

The following examples are provided to further illustrate this invention and are not to be considered as unduly limiting the scope of this invention.

EXAMPLES

A computer model was used for examples I and II to calculate product yields from the conversion of a heavy hydrocarbon stream to light olefins and aromatics when passed over a phosphorus promoted ZSM-5 catalyst. The heavy hydrocarbon stream composition used as an input to the computer model was obtained from an analysis of a catalytically cracked gasoline stream from a catalytic cracking unit of a refinery.

Calculated Example I

This example illustrates the benefit of increased olefin yield that results from recycling $C_5$ and $C_6$ paraffins in a process of contacting a heavy hydrocarbon with a phosphorous modified zeolite.

Process parameters for model runs A and B include a temperature of 600° C., a pressure of 10 psig and a WHSV of 2 $hr.^{-1}$ for the heavy hydrocarbon stream feed. In run B, the $C_5$ and $C_6$ paraffins from the reactor effluent are recycled and contacted with the phosphorus modified zeolite along with the heavy hydrocarbon stream feed. Results are presented in Table I.

TABLE I

| Component | Feed Wt. % | Run A No Paraffin Co-Feed, No $C_5$–$C_6$ Recycle Product Weight % | Run B No Paraffin Co-Feed, $C_5$–$C_6$ Recycle Product Weight % | Δ |
|---|---|---|---|---|
| $C_4$ - Paraffins and $H_2$ | — | 29.79 | 34.02 | +14.2% |
| Ethylene | — | 8.10 | 9.51 | +17.4% |
| Propylene | — | 13.12 | 15.57 | +18.7% |
| Butylenes | 0.24 | 5.84 | 6.98 | +19.5% |
| $C_5$ paraffins | 6.37 | 12.30 | — | −100% |
| $C_5$ olefins and naphthenes | 9.67 | — | — | — |
| $C_6$ paraffins | 7.12 | 0.93 | — | −100% |
| $C_6$ olefins and naphthenes | 9.66 | — | — | — |
| Benzene | 1.18 | 3.10 | 3.54 | +14.2% |
| $C_7$ paraffins | 5.61 | — | — | — |
| $C_7$ olefins & naphthenes | 10.30 | — | — | — |
| Toluene | 5.20 | 8.56 | 9.70 | +13.3% |
| $C_8$ paraffins | 4.67 | — | — | — |

TABLE I-continued

| Component | Feed Wt. % | Run A No Paraffin Co-Feed, No $C_5$–$C_6$ Recycle Product Weight % | Run B No Paraffin Co-Feed, $C_5$–$C_6$ Recycle Product Weight % | Δ |
|---|---|---|---|---|
| $C_8$ olefins and naphthenes | 4.33 | — | — | — |
| Ethyl Benzene | — | 0.57 | 0.64 | +12.3% |
| Xylene | 8.40 | 7.18 | 8.14 | +13.4% |
| $C_9$+ paraffins | 6.64 | — | — | — |
| $C_9$+ olefins and naphthenes | 1.75 | — | — | — |
| $C_{9+}$ aromatics | 18.86 | 10.35 | 11.71 | +13.1% |
| Coke | — | 0.16 | 0.19 | +18.8% |
| Total | 100 | 100 | 100 | — |
| Petrochemicals (BTX, $C_2$=, $C_3$= and $C_4$=) | 15.02 | 45.9 | 53.44 | +16.4% |

As presented in Table I, the yield of light olefins, ethylene, propylene and butylenes, as well as the yield of all petrochemicals, BTX and light olefins, increased with the recycle of $C_5$–$C_6$ paraffins.

Calculated Example II

This example illustrates the benefit of increased olefin yield that results from introducing a paraffin stream co-feed in a process of contacting a heavy hydrocarbon with a phosphorus modified zeolite.

Process parameters for model runs B and C include a temperature of 600° C. and a pressure of 10 psig. The WHSV of the heavy hydrocarbon feed stream for model run B is 2 $hr.^{-1}$. In model run C, a paraffin co-feed stream is charged to the reaction zone for contact with the phosphorus modified zeolite along with the heavy hydrocarbon feed stream. For model run C, the WHSV for the heavy hydrocarbon feed stream is 0.96 and the WHSV for the paraffin co-feed stream is 1.04. Results are presented in Table II.

TABLE II

| Component | Feed Wt. % | Paraffin Co-Feed Wt. % | Run B No Paraffin Co-Feed, $C_5$–$C_6$ Recycle Product Weight % | Run C Paraffin Co-Feed, $C_5$–$C_6$ Recycle Product Weight % | Δ |
|---|---|---|---|---|---|
| $C_4$ - Paraffins and $H_2$ | — | — | 34.02 | 29.60 | −13.0% |
| Ethylene | — | — | 9.51 | 12.18 | +28.1% |
| Propylene | — | — | 15.57 | 22.12 | +42.1% |
| Butylenes | 0.24 | — | 6.98 | 11.00 | +57.6% |
| $C_5$ paraffins | 6.37 | 73 | — | — | — |
| $C_5$ olefins and naphthenes | 9.67 | — | — | — | — |
| $C_6$ paraffins | 7.12 | 9 | — | — | — |
| $C_6$ olefins and naphthenes | 9.66 | — | — | — | — |
| Benzene | 1.18 | — | 3.54 | 2.75 | −22.3% |
| $C_7$ paraffins | 5.61 | 9 | — | — | — |
| $C_7$ olefins & naphthenes | 10.30 | — | — | — | — |
| Toluene | 5.20 | — | 9.70 | 6.80 | −29.9% |
| $C_8$ paraffins | 4.67 | 9 | — | — | — |
| $C_8$ olefins and naphthenes | 4.33 | — | — | — | — |
| Ethyl Benzene | — | — | 0.64 | 0.44 | −31.3% |
| Xylene | 8.40 | — | 8.14 | 5.90 | −27.5% |
| $C_9$+ paraffins | 6.64 | — | — | — | — |
| $C_9$+ olefins and naphthenes | 1.75 | — | — | — | — |
| $C_{9+}$ aromatics | 18.86 | — | 11.71 | 9.09 | −22.4% |
| Coke | — | — | 0.19 | 0.12 | −36.8% |
| Total | 100 | 100 | 100 | 100 | — |
| Petrochemicals (BTX, $C_2$=, $C_3$= and $C_4$=) | 15.02 | — | 53.44 | 60.75 | +13.7% |

As presented in Table II, the yield of light olefins, as well as the yield of all petrochemicals, significantly increased with the introduction of a paraffin stream co-feed.

The percentage increases in yield by weight, resulting from the introduction of the paraffin stream co-feed, for ethylene, propylene and butylenes are 28.1%, 42.1%, and 57.6%, respectively. The overall yield increase for petrochemicals is 13.7% by weight.

It has also been discovered that the addition of the paraffin stream co-feed reduces the level of coke formation, as can be seen in Table II, wherein coke production decreased 36.8% by weight as compared to coke production without paraffin co-feed. This reduced coke formation will result in longer run-times for fixed bed catalyst reactors between reactor shutdowns for coke removal. Also, this lower coke formation rate enables this process to be run in a continuous catalyst regeneration reactor configuration.

Whereas this invention has been described in terms of the preferred embodiments, reasonable variations and modifications are possible by those skilled in the art. Such modifications are within the scope of the described invention and appended claims.

That which is claimed is:

1. A method for increasing the conversion of heavy hydrocarbons to light olefins in a process for converting heavy hydrocarbons to light olefins and BTX, said method comprising:

(a) introducing a heavy hydrocarbon stream comprising a heavy hydrocarbon having at least 5 carbon atoms per molecule into a reaction zone containing a zeolite catalyst and operated under reaction conditions for converting said heavy hydrocarbon stream to light olefins and BTX;

(b) introducing a paraffin stream comprising a paraffin into said reaction zone as a co-feed with said heavy hydrocarbon stream, said paraffin comprises pentane;

(c) withdrawing from said reaction zone a reactor effluent comprising light olefins;

(d) identifying a percent conversion of said heavy hydrocarbon stream to light olefins when there is no introducing step (b); and (e) controlling the rate of introduction of said paraffin stream of introducing step (b) such that the percent conversion of said heavy hydrocarbon stream to light olefins exceeds said percent conversion of identifying step (d).

2. A method as recited in claim 1, further comprising:

(f) separating said reactor effluent into a recyclable stream comprising a paraffin hydrocarbon having at least 5 carbon atoms per molecule and a product stream comprising light olefins; and (g) introducing at least a portion of said recyclable stream into said reaction zone.

3. A method as recited in claim 2 wherein said heavy hydrocarbon of said heavy hydrocarbon stream comprises cracked gasoline including hydrocarbons having 6 or more carbon atoms per molecule.

4. A method as recited in claim 3 wherein said heavy hydrocarbon of said heavy hydrocarbon stream further comprises non-saturates.

5. A method as recited in claim 4 wherein said paraffin further comprises a hydrocarbon compound selected from the group consisting of hexanes, heptanes and octanes.

6. A method as recited in claim 5 wherein controlling step (e) provides for a mole ratio of said paraffin to said heavy hydrocarbon introduced into said reaction zone in the range of from about 0.1:10 to about 10:0.1.

7. A method as recited in claim 6 wherein said zeolite catalyst is promoted with a compound selected from the group consisting of sulfur, phosphorus, silicon, boron, magnesium, zinc, tin, titanium, zirconium, molybdenum, germanium, indium, lanthanum, cesium, iron, nickel, chromium and cobalt.

8. A method as recited in claim 7 wherein said compound is phosphorus.

9. A method as recited in claim 8 wherein the reaction conditions of said reaction zone include a reaction temperature in the range of from about 400° C. to about 800° C., a reaction pressure in the range of from about 0 psia to about 500 psia and a weight hourly space velocity in the range of from about 0.01 $hr.^{-1}$ to about 1000 $hr.^{-1}$.

10. A process for the conversion of a heavy hydrocarbon stream to light olefins, said process comprises the steps of:

(a) introducing said heavy hydrocarbon stream comprising a heavy hydrocarbon having at least 5 carbon atoms per molecule to a reaction zone, said reaction zone contains a zeolite catalyst and is operated under reaction conditions for converting heavy hydrocarbons to light olefins;

(b) withdrawing from said reaction zone a reactor effluent comprising light olefins; and (c) controllably introducing a paraffin stream comprising a paraffin, said paraffin comprises pentane, to said reaction zone such that the mole ratio of said paraffin to said heavy hydrocarbon introduced into said reaction zone is in the range of from about 0.1:10 to about 10:0.1, whereby the percent conversion of said heavy hydrocarbon stream to light olefins is enhanced over the percent conversion of said heavy hydrocarbon stream to light olefins when there is no step (c).

11. A process as recited in claim 10, further comprising:

(d) separating said reactor effluent to produce a recyclable stream comprising a paraffin hydrocarbon having at least 5 carbon atoms per molecule and a product stream comprising light olefins; and (e) introducing at least a portion of said recyclable stream to said reaction zone.

12. A method as recited in claim 11 wherein said heavy hydrocarbon of said heavy hydrocarbon stream comprises cracked gasoline primarily including hydrocarbons having 6 or more carbon atoms per molecule.

13. A method as recited in claim 12 wherein said heavy hydrocarbon of said heavy hydrocarbon stream further comprises non-saturates.

14. A method as recited in claim 13 wherein said paraffin further comprises a hydrocarbon compound selected from the group consisting of hexanes, heptanes and octanes.

15. A process as recited in claim 14 wherein said reaction zone is operated at a temperature in the range of from about 400° C. to about 800° C., a reaction pressure in the range of from about 0 psia to about 500 psia and a weight hourly space velocity in the range of from about 0.01 $hr.^{-1}$ to about 1000 $hr.^{-1}$.

16. A process as recited in claim 15 wherein said zeolite catalyst is promoted with a compound selected from the group consisting of sulfur, phosphorus, silicon, boron, magnesium, zinc, tin, titanium, zirconium, molybdenum, germanium, indium, lanthanum, cesium, iron, nickel, chromium and cobalt.

17. A process as recited in claim 16 wherein said compound is phosphorus.

18. A method for increasing the yield of light olefins in a process for converting heavy hydrocarbons to light olefins and BTX, said method comprising;

(a) introducing a heavy hydrocarbon stream comprising at least one heavy hydrocarbon having at least 5 carbon atoms per molecule into a reaction zone containing a zeolite catalyst and operated under reaction conditions for converting said heavy hydrocarbon stream to light olefins and BTX;

(b) introducing a paraffin stream comprising a paraffin into said reaction zone as a co-feed with said heavy hydrocarbon stream, said paraffin comprises pentane;

(c) withdrawing from said reaction zone a reactor effluent comprising light olefins;

(d) controlling the rate of introduction of said paraffin stream of introducing step (b) such that the percent conversion of said heavy hydrocarbon stream to light olefins exceeds the percent conversion of said heavy hydrocarbon stream to light olefins when there is no introducing step (b).

19. A method as recited in claim 18, further comprising:

(e) separating said reactor effluent into a recyclable stream comprising a paraffin hydrocarbon having at least 5 carbon atoms per molecule and a product stream comprising light olefins; and (f) introducing at least a portion of said recyclable stream into said reaction zone.

20. A method as recited in claim 19 wherein said at least one heavy hydrocarbon of said heavy hydrocarbon stream comprises cracked gasoline including hydrocarbons having 6 or more carbon atoms per molecule.

21. A method as recited in claim 20 wherein said at least one heavy hydrocarbon of said heavy hydrocarbon stream further comprises non-saturates.

22. A method as recited in claim 21 wherein said paraffin further comprises a hydrocarbon compound selected from the group consisting of hexanes, heptanes and octanes.

23. A method as recited in claim 22 wherein said zeolite catalyst is promoted with a compound selected from the group consisting of sulfur, phosphorus, silicon, boron, magnesium, zinc, tin, titanium, zirconium, molybdenum, germanium, indium, lanthanum, cesium, iron, nickel, chromium and cobalt.

24. A method as recited in claim 23 wherein said compound is phosphorus.

25. A method as recited in claim 24 wherein controlling step (d) provides for a mole ratio of said paraffin to said at least one heavy hydrocarbon introduced into said reaction zone in the range of from about 0.1:10 to about 10:0.1.

26. A method as recited in claim 25 wherein the reaction conditions of said reaction zone include a reaction temperature in the range of from about 400° C. to about 800° C., a reaction pressure in the range of from about 0 psia to about 500 psia, and a weight hourly space velocity in the range of from about 0.01 $hr.^{-1}$ to about 1000 $hr.^{-1}$.

27. A method as recited in claim 1 wherein said zeolite catalyst is promoted with a compound selected from the group consisting of sulfur, silicon, boron, magnesium, zinc, tin, titanium, zirconium, molybdenum, germanium, indium, lanthanum, cesium, iron, nickel, chromium and cobalt.

28. A process as recited in claim 10 wherein said zeolite catalyst is promoted with a compound selected from the group consisting of sulfur, silicon, boron, magnesium, zinc, tin, titanium, zirconium, molybdenum, germanium, indium, lanthanum, cesium, iron, nickel, chromium and cobalt.

29. A method as recited in claim 18 wherein said zeolite catalyst is promoted with a compound selected from the group consisting of sulfur, silicon, boron, magnesium, zinc, tin, titanium, zirconium, molybdenum, germanium, indium, lanthanum, cesium, iron, nickel, chromium and cobalt.

30. A method for increasing the conversion of heavy hydrocarbons to light olefins in a process for converting heavy hydrocarbons to light olefins and BTX, said method comprising:

(a) introducing a heavy hydrocarbon stream comprising a heavy hydrocarbon having at least 5 carbon atoms per molecule into a reaction zone containing a catalyst consisting essentially of a zeolite having incorporated therein a promoter selected from the group consisting of sulfur, silicon, boron, tin, magnesium, germanium, zinc, titanium, zirconium, molybdenum, lanthanum, cesium, iron, cobalt, nickel and combinations of any two or more thereof, and operated under reaction conditions for converting said heavy hydrocarbon stream to light olefins and BTX;

(b) introducing a paraffin stream comprising a paraffin into said reaction zone as a co-feed with said heavy hydrocarbon stream, said paraffin comprises pentane;

(c) withdrawing from said reaction zone a reactor effluent comprising light olefins;

(d) identifying a percent conversion of said heavy hydrocarbon stream to light olefins when there is no introducing step (b); and (e) controlling the rate of introduction of said paraffin stream of introducing step (b) such that the percent conversion of said heavy hydrocarbon stream to light olefins exceeds said percent conversion of identifying step (d).

31. A method as recited in claim 30, further comprising:

(f) separating said reactor effluent into a recyclable stream comprising a paraffin hydrocarbon having at least 5 carbon atoms per molecule and a product stream comprising light olefins; and (g) introducing at least a portion of said recyclable stream into said reaction zone.

32. A method for increasing the conversion of heavy hydrocarbons to light olefins in a process for converting heavy hydrocarbons to light olefins and BTX, said method comprising:

(a) introducing a heavy hydrocarbon stream comprising a heavy hydrocarbon having at least 5 carbon atoms per molecule into a reaction zone containing a catalyst consisting of a zeolite having incorporated therein a promoter selected from the group consisting of sulfur, silicon, boron, tin, magnesium, germanium, zinc, titanium, zirconium, molybdenum, lanthanum, cesium, iron, cobalt, nickel and combinations of any two or more thereof, and operated under reaction conditions for converting said heavy hydrocarbon stream to light olefins and BTX;

(b) introducing a paraffin stream comprising a paraffin into said reaction zone as a co-feed with said heavy hydrocarbon stream, said paraffin comprises pentane;

(c) withdrawing from said reaction zone a reactor effluent comprising light olefins;

(d) identifying a percent conversion of said heavy hydrocarbon stream to light olefins when there is no introducing step (b); and (e) controlling the rate of introduction of said paraffin stream of introducing step (b) such that the percent conversion of said heavy hydrocarbon stream to light olefins exceeds said percent conversion of identifying step (d).

33. A method as recited in claim 32, further comprising:

(f) separating said reactor effluent into a recyclable stream comprising a paraffin hydrocarbon having at least 5 carbon atoms per molecule and a product stream comprising light olefins; and (g) introducing at least a portion of said recyclable stream into said reaction zone.

* * * * *